US005476433A

United States Patent [19]

Bruner

[11] Patent Number: 5,476,433

[45] Date of Patent: Dec. 19, 1995

[54] UNIVERSAL MARTIAL ARTS TRAINING APPARATUS

[76] Inventor: Peter W. Bruner, 1440 Dura Dr., Marietta, Ga. 30060

[21] Appl. No.: 183,680

[22] Filed: Jan. 19, 1994

[51] Int. Cl.[6] ..... A63B 69/00

[52] U.S. Cl. ..... 482/87; 482/83; 482/90

[58] Field of Search ..... 273/29 R, 29 A; 27/188 R, 190; 403/396, 391, 398; 269/43; 482/83–90, 148; 108/106

[56] References Cited

U.S. PATENT DOCUMENTS

| | | | |
|---|---|---|---|
| 1,104,505 | 7/1914 | Holworthy | 482/24 |
| 2,977,118 | 3/1961 | Farkas | 482/87 |
| 3,881,687 | 5/1975 | Johansson | 254/108 |
| 4,295,646 | 10/1981 | Squire | 482/83 |
| 4,403,772 | 9/1983 | Stangle | 482/90 |
| 4,482,150 | 11/1984 | Levine . | |
| 4,557,478 | 12/1985 | Levine | 482/90 |
| 4,749,184 | 6/1988 | Tobin | 482/86 |
| 4,776,584 | 10/1988 | Tilley et al. . | |
| 4,807,871 | 2/1989 | Bryson . | |
| 4,817,941 | 4/1989 | McCorry | 482/87 |
| 4,889,334 | 12/1989 | Partlo . | |
| 4,973,045 | 11/1990 | Heberer . | |
| 5,254,062 | 10/1993 | Hoffman . | |
| 5,286,241 | 2/1994 | Petrakis | 482/83 |
| 5,299,990 | 4/1994 | Mehlhoff | 482/92 |

FOREIGN PATENT DOCUMENTS

| | | | |
|---|---|---|---|
| 312286 | 8/1930 | United Kingdom | 273/190 R |

*Primary Examiner*—Richard J. Apley
*Assistant Examiner*—Jerome Donnelly
*Attorney, Agent, or Firm*—Marvin L. Moore

[57] ABSTRACT

A universal martial arts training apparatus comprising a support module which has a plurality of upstanding support members equidistantly spaced in parallel relation. The support members are rigidly reinforced at opposing ends by interconnecting means. The support module presents independent training stations at a single location in a mutually cooperative relationship and includes speed break, power break, heavy weight bag, and board holder. The training stations are slidably mounted to upstanding support member or members lowered to the desired height, and locked into position.

3 Claims, 5 Drawing Sheets

Fig. 10
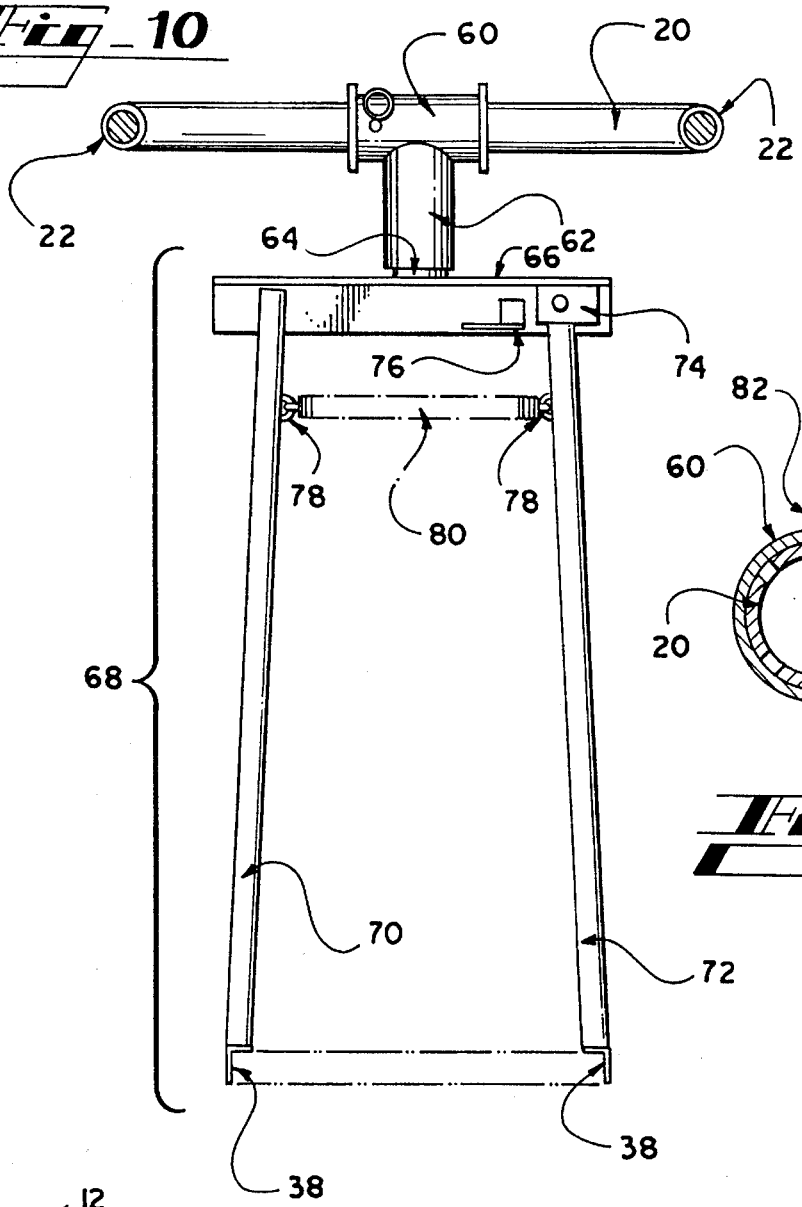
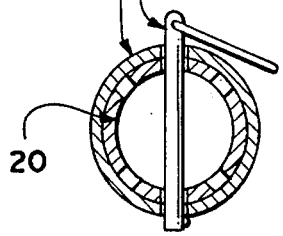
Fig. 9
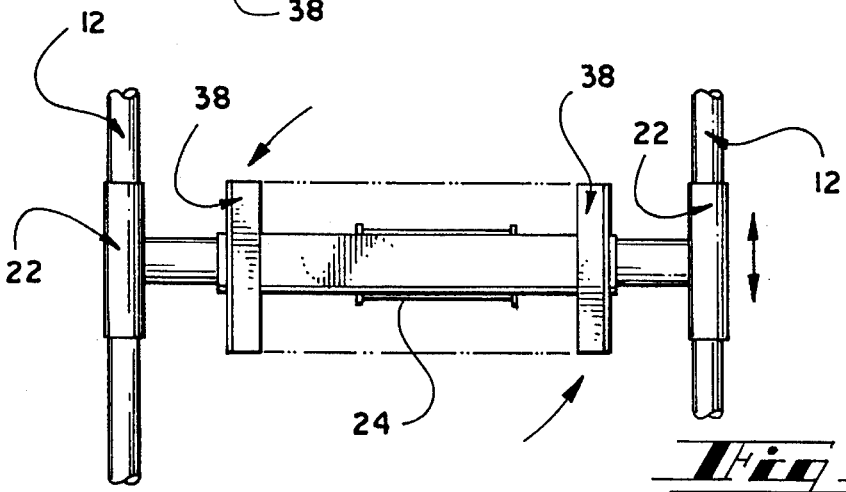
Fig. 11

UNIVERSAL MARTIAL ARTS TRAINING APPARATUS

FIELD OF THE INVENTION

The present invention relates generally to a modular training apparatus which combines individual training stations.

BACKGROUND OF THE INVENTION

Participants of martial arts, as in Tae Kwon Do, Kung Fu, karate, and kick boxing require a means of maintaining, improving, and accurately evaluating kicking and punching skills. Instructors also require a means of demonstrating various blows without risking injury to themselves or others. To achieve the aforementioned, boards commonly held by onlookers are used as targets. However, manual board holders fearful of flying boards, broken fingers, or broken wrists resulting from the power delivered to break boards may unconsciously pull away from the blow. Thereby, ultimately increasing the risk of injury to both the board holder and breaker from an off target blow. An accurate means of evaluating individual performance is also difficult because sparring participants typically reduce the force of their kicks and punches to avoid permanent damage to their opponent. In addition, hours upon hours of individual training on speed, timing, accuracy and power are necessary for maintaining and improving individual proficiency on the various techniques employed in martial arts. However, the amount and quality of individual training time is often restricted for most participants due to the inability to secure the assistance of a skilled board holder.

Various patents have been granted on devices which address and eliminate the need for manual board holders. Representative of the prior art devices include the following.

U.S. Pat. No. 4,889,334 to Partlo discloses a device which provides a martial arts board holding structure which substantially reduces the possibility of injury to the hand or foot of the user, while minimizing the possibility of damage to the device itself. Furthermore, this device is adjustable and can hold from one to a substantial number of boards to be broken. A pedestal stand is attached to the board securing the frame member so as to support same at a desired position above the floor surface.

U.S. Pat. No. 4,973,045 to Heberer discloses an apparatus for positioning and securing at least one board at a selected height and angle. This apparatus also replaces the need of a human holder in the practice of breaking boards in martial arts competition.

U.S. Pat. No. 4,749,184 to Tobin discloses a kicking practice apparatus which basically provides a free-standing support frame and an arm pivotally mounted to the frame and holding a padded target. The apparatus is portable so as to allow it to be set-up and subsequently taken down by one person.

While these practice devices would appear to operate reasonably well and generally achieve their objectives under the limited range of operating condition for which they were designed, those devices embody one or more of the following drawbacks. When considered individually, the prior art devices are limited as to the array of punches and kicks which can be practiced due to the restricted elevation and/or angle these devices can duplicate. Moreover, devices which condition specialized skills tend to become spread throughout a training center and often when found are in disrepair.

U.S. Pat. No. 4,403,772 to Stangle recognized the disadvantages of similar board holding devices and discloses a unitary structure which provides training in a variety of activities for one or more individuals simultaneously.

The immediately foregoing training apparatus is closest in purpose to the present invention in as much as it provides a unitary physical conditioning structure. However, the training units of the prior structure are mounted at fixed positions and provide conditioning for only the most basic kicks and punches. Moreover, the framed structure of said apparatus is not designed to accept additional training units.

The aforementioned U.S. Patents are illustrative of the prior art training devices. There remains a need for a universal martial arts training apparatus which does not possess the disadvantages associated with the training devices known to date.

SUMMARY OF THE INVENTION

It is therefore, an object of this invention to provide a universal martial arts training apparatus which affords an accurate means of evaluating individual punching and kicking skills.

It is another object of this invention to provide a universal martial arts training apparatus which affords versatility to one or more participants for simultaneous training with various training stations.

It is another object of this invention to provide a universal martial arts training apparatus which affords interconnectable modular units.

It is a further object of this invention to provide a universal martial arts training apparatus which affords adjustable training stations.

An even further object of this invention is to provide a universal martial arts training apparatus which affords a series of independent training stations for presentation at a single location in a mutually cooperative relationship.

The present invention provides a universal martial arts training apparatus comprising a support module which has a plurality of upstanding support members equidistantly spaced in parallel relation. The support members are rigidly reinforced at opposing ends by interconnecting means. The module is secured to a fixed structure such as a support column or wall by upper and lower mounting brackets. Training stations are slidably mounted to the upstanding support members.

The support module in a basic embodiment has a comer configuration comprising three upstanding support members arranged in a right angular configuration by upper and lower right angular interconnecting means. Each corner support module can be interconnected with two or more such modules. In a modified embodiment, a basic module may be designed having a linear configuration. Both corner and linear support modules may also be interconnected to provide a training apparatus having a multitude of configurations.

The support module provides a base which is rigid enough to withstand the forces which will be delivered to the training stations. To mount a training station onto a support module, first remove the upper interconnecting means and upper module mounting bracket. The station is then slidably mounted over the upstanding member or members, lowered to the desired height, and locked into position. The module mounting bracket and interconnecting means are then returned to their original positions. A single right angular support module can accommodate up to four training stations.

The support module presents independent training stations at a single location in a mutually cooperative relationship and includes, but not limited to a speed break, power break, heavy weight bag and board holder stations. In combination with the modular apparatus of the present invention, the aforementioned stations provide an improved means for evaluating and teaching the skills required in martial arts conditioning.

Other aspects, objects, features and advantages of the present invention will become apparent to those skilled in the art upon reading the detailed description of preferred embodiments in conjunction with the accompanying drawings and appended claims.

DESCRIPTION OF THE DRAWINGS

In the drawings, which are discussed below, the same reference numerals refer to the same features of the invention throughout the drawings. A universal martial arts training apparatus according to a preferred embodiment of the invention is shown in FIGS. 1–12.

FIG. 9 represents a cross sectional view showing the removable pin used to position the board holder's elevation.

FIG. 10 represents a top view of the board holder training station.

FIG. 11 represents a front view of the board holder training station.

DETAILED DESCRIPTION

While the specification concludes with claims particularly pointing out and distinctly claiming the subject matter which is regarded as the invention, the invention will now be described by reference to the following description of preferred embodiments taken in conjunction with the accompanying drawings.

Figure 1:
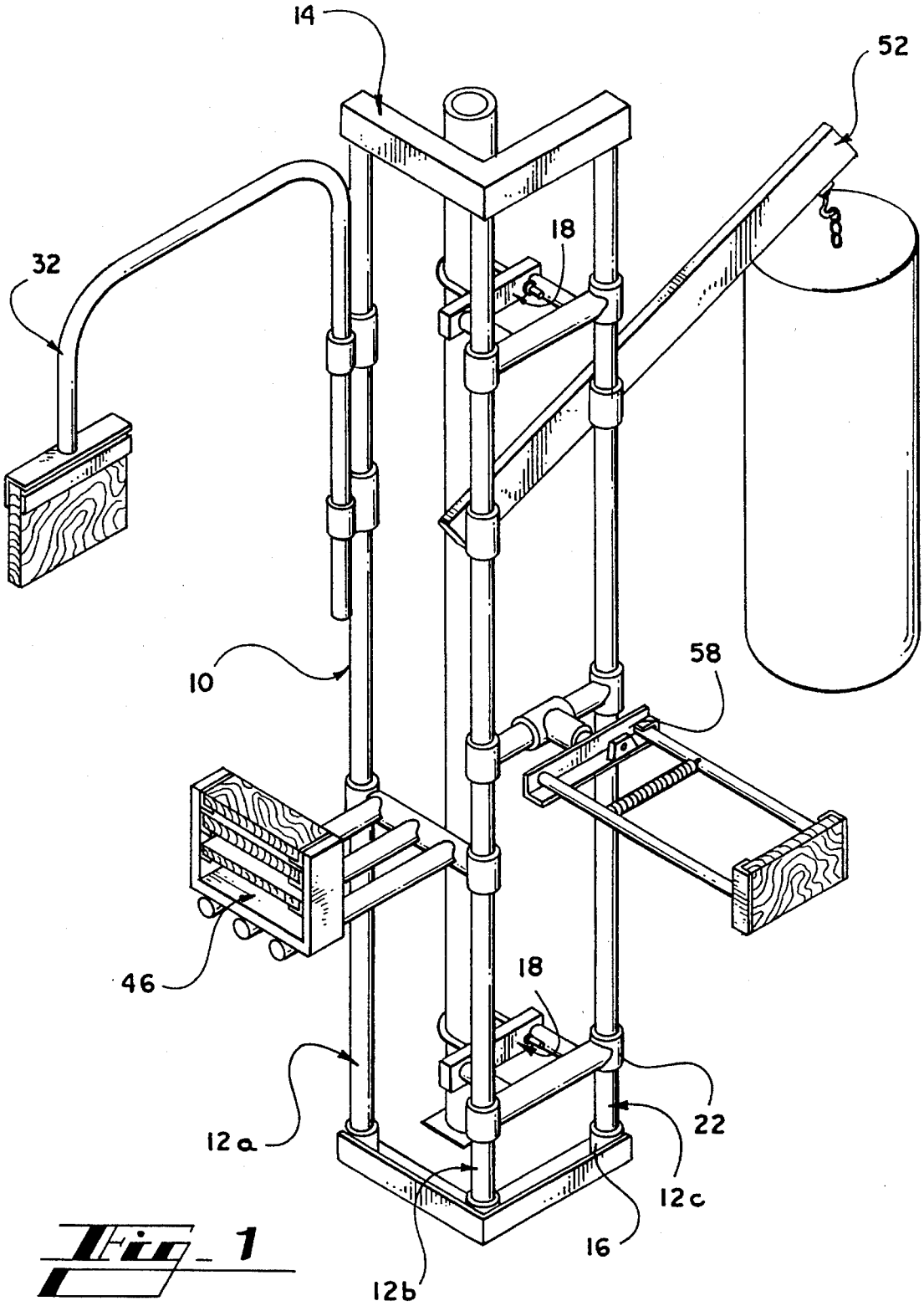
FIG. 1 is a perspective view of the universal martial arts training apparatus according to the present invention.

Referring now to the drawings and particularly to FIG. 1, there is shown a universal martial arts training apparatus generally designated by numeral 10 and constituting one embodiment of the present invention. The present training apparatus has as its components a corner support module comprising a plurality of upstanding support members 12 which upstanding members are connected by upper and lower interconnecting means 14. With the preceding are training stations 32, 46, 52, and 58.

The upstanding members 12 are tubular cylindrical poles composed of a metal or metal alloy material. It is preferred that said members and all metal components be forged from a weldable steel. The upstanding members 12 are of equal length, and equidistantly spaced in parallel relation. Interconnecting means 14 are used to secure the upstanding support members in alignment. The corner interconnecting means 14 of the present embodiment comprises an angle member having a right angular configuration. Disposed within the angle of the corner interconnecting means and equally spaced from corner to end are three tubular end collars 16. The end collars 16 are designed to receive it he upper and lower ends of upstanding support members 12.

Figure 12:
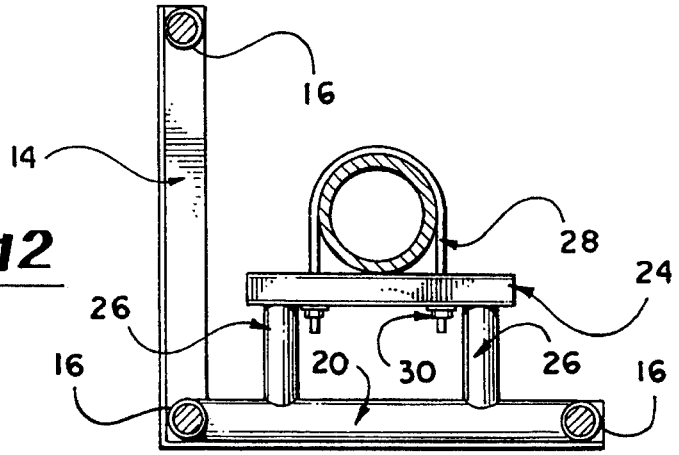
FIG. 12 represents a top view of the fight angular module.

To erect a corner support module upper and lower mounting brackets 18 are attached to upstanding members 12, as seen in FIG. 12. Each mounting bracket 18 comprises a cross bar 20, header 24, intermediate members 26, and fastening nuts 30. The cross bar 20 is a major structural feature of the present invention. It comprises a pair of cylindrical collars 22 connected at opposing ends to be slidably fitted over adjacent upstanding support members 12 and interposed there between. Each cross bar 20 is designed similarly and has as its principal utility a means for mounting stations to be module. The cross bar 20 and any other slidable components are locked in place by set screws or any other conventional means. Connecting the cross bar 20 to the header 24 are intermediate members 26. The corner support modular configuration is achieved once the upper and lower mounting brackets 18 are secured, and first, second, and third upstanding support members 12*a*, 12*b*, 12*c* are reinforced by upper and lower right angular interconnecting means 14. The module is then positioned so that the header 24 of the mounting brackets 18 abutts a fixed structure such as a structural beam or column. A generally U-shaped fastening means 28 or the like is placed around the fixed structure and through holes suitably placed in the header 24 to bolt the support module in place.

The support module is constructed to provide a base which is rigid enough to withstand forces delivered to the training stations with very negligible oscillation.

To connect a training station onto the support module, remove the upper interconnecting member 14 and upper mounting bracket 18. The collars of the training station are then slidably fitted over the upstanding member or members 12, lowered to the desired height and locked into position. The mounting bracket 18 and interconnecting member 14 are then returned to their positions to restore the modules rigidity.

A single corner support module can accommodate up to four training stations. Each station acts independently for the teaching and conditioning of specific martial arts techniques and include: speed break 36, power break 46, weight bag 52, and board holder 58. Additional training stations for teaching and conditioning other aspects of martial arts or any other sport requiring like conditioning may also be developed and retrofitted for connection with the present support module.

Figure 3:
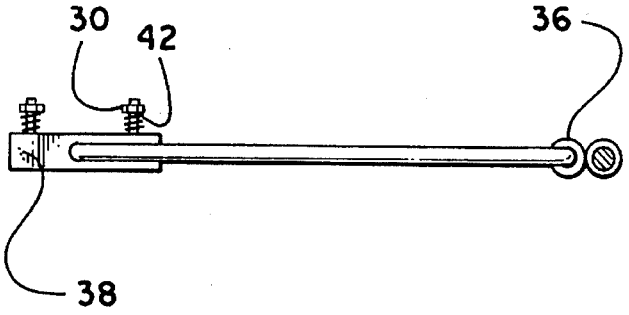
FIG. 3 represents a top view of the speed break training station.
Figure 2:
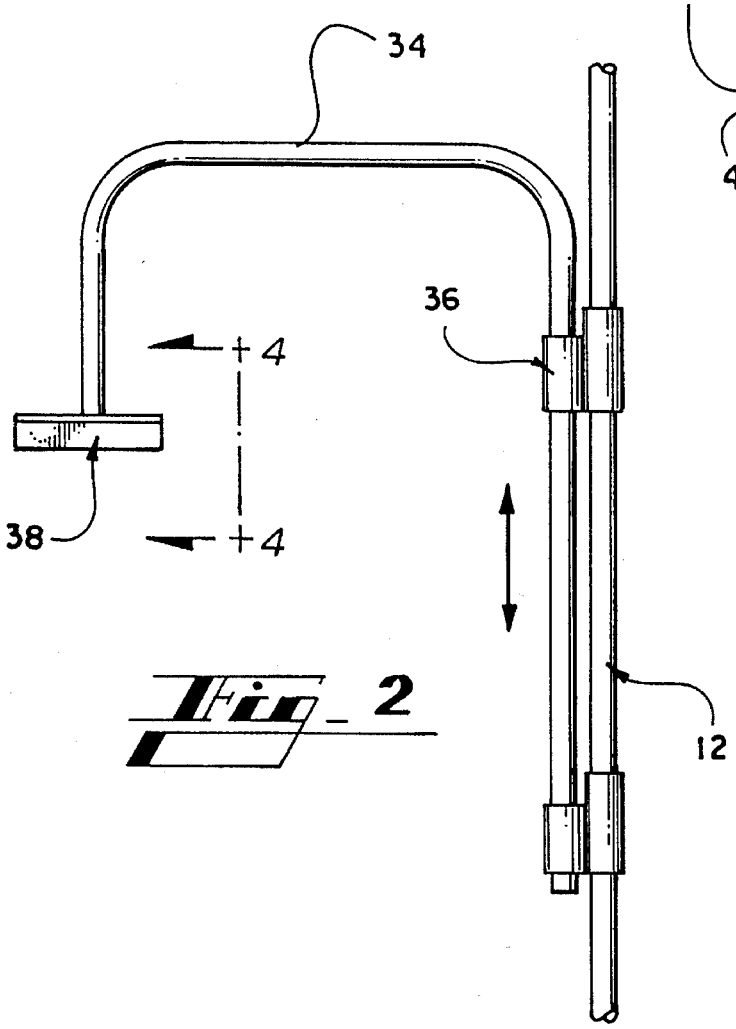
FIG. 2 represents a side view of the speed break training station.
Figure 4:
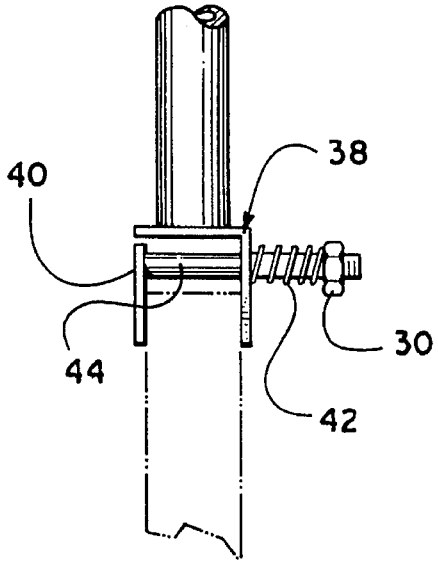
FIG. 4 represents an enlarged view in partial section taken generally along line 4—4 of FIG. 2 and illustrates a board suspending device.

As illustrated in FIGS. 2, 3 and 4, the speed break 32 includes a cylindrical arched extension member 34 which extends away from the module and is attached to the module's upstanding support member 12 by a pair of dual collar members 36. The dual collars 36 allow the speed break station to slide vertically along the upstanding support member 12 and positioned at various heights. Attached at the extended end of said arched member is an angled member 38. As best shown in FIG. 4, which is an enlarged view in partial section taken generally along line 4—4 of FIG. 2, is the board suspending device. This device suspends a target board, shown in phantom, between the angled member 38 and flat plate member 40. As can be seen in FIG. 4 taken in conjunction with FIG. 3, plate member 40 has two threaded bolt members 44 extending perpendicularly from a side which are received by holes in angled member 38. Once in place, each bolt member 44 is mounted by a spring 42 and secured by fastening nuts 30. It is important to point out that the board clamping device of FIG. 4 is designed to loosely suspend the target board just as if held by fingertips so that the target board is broken solely by the force of the blow delivered.

The speed break station eliminates the need to have a manual board holder stand on a chair or ladder to achieve the target elevation needed to perform and teach speed breaking.

Figure 5:
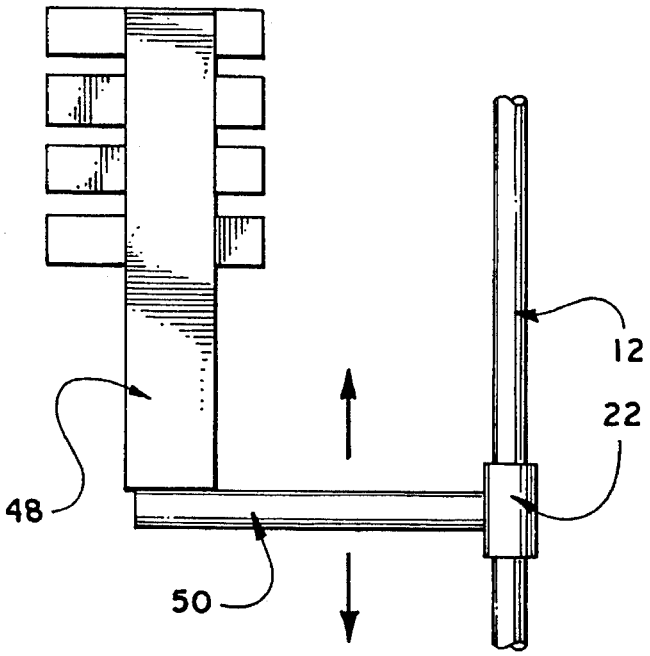
FIG. 5 represents a side view of the power break training station.
Figure 6:
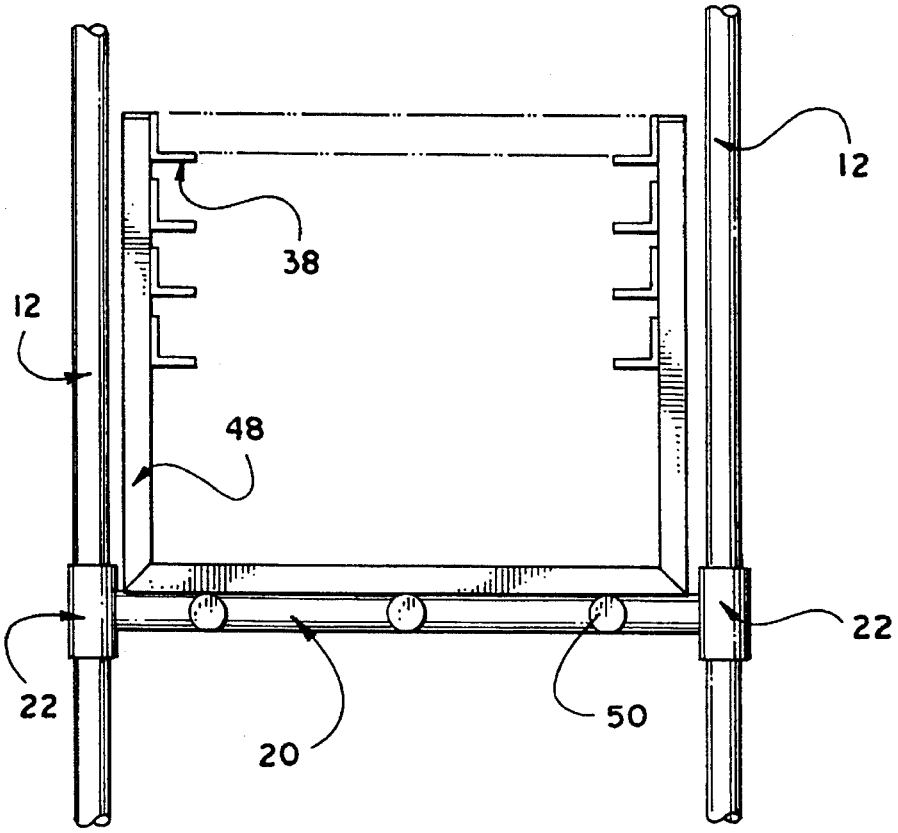
FIG. 6 represents a front view of the power break bag training station.

The power break station 46 as seen in FIGS. 5 and 6 includes a cross bar 20, horizontal supports 50 and a board shelving member 48. Along the vertical inner walls of the shelving member 48 are equally spaced angle member 38 on which the target boards are stacked. The walls of the shelving member 48 also aid in minimizing the hazards from flying boards. Horizontal supports 50 are attached to cross bar 20 at one end extending away from the module and attached to the board shelving member 48 at their other end. The board shelving member 48 can hold from one to a substantial number of boards. The cross bar 20 can be raised or lowered to achieve the optimal height for the user. The power break station trains and conditions techniques for ax kicks, hammer fist, and knife hands and used to measure depth of power.

Figure 7:
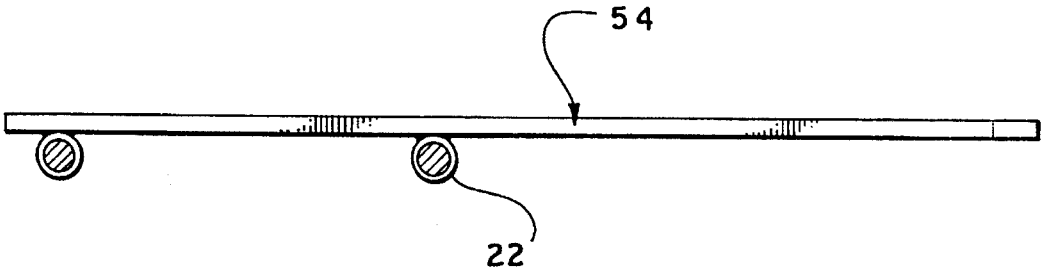
FIG. 7 represents a top view of the weight bag training station.
Figure 8:
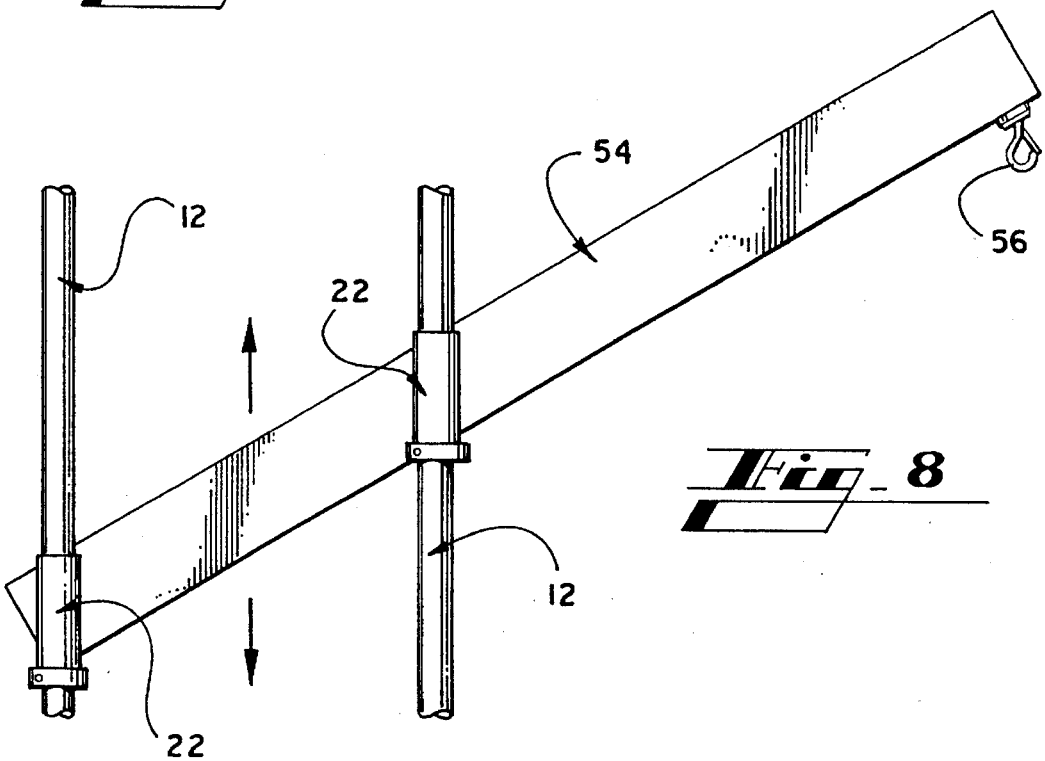
FIG. 8 represents a side view of the weight bag training station.

Referring now to FIGS. 7 and 8, there is shown the heavy bag station 52 which comprises a support rail 54 which extends slightly upward and outward in coplanar relation with the support members 12 to which it is attached. The support rail 54 has two collars 22 attached to a side and spaced to be slidably received over two adjacent support members, lowered to the desired height and locked into position. The support rail 54 is constructed of tubing which has a rectangular cross-section and of sufficient strength to support the weight of most commercially available heavy weight bags. At the uppermost end of said rail is a swivel spring clamp 56 or the like and removably tethered therefrom is the heavy weight bag.

As seen in FIGS. 9, 10 and 11, the board holder station 58 is attached to the support module by way of a cross bar 20. Positioned over the cross bar midway between the collars and sized to slidably fit about the cross bar 20 is a rotating member 60 which has a hub 62 affixed centrally and extending perpendicularly therefrom. Slidably positioned within said hub 62 is extension member 64 having attached at its opposing end a board clamping device 68 extending from support module in a cantilever fashion.

The board clamping device 64 comprises basically a header 66, fixed arm 70, pivoting arm 72, and spring member 80. The angled header 66 is centrally attached to the end of the extension member 62. A fixed arm 70 is attached near an edge of the header 66. Attached near the opposite edge of said header is a pivoting means 74 which supports a pivoting arm 72. Attached to the inner side of said pivot means 74 is a stop member 76 which prevents the arms 70, 72 from touching when in the rest position. Connecting the arms 70, 72 is a spring member 80 which is attached to hooks 78 on said arms. At the extended end of said arms are angled members 38 which receive the target board. To position the target board within the board clamping device 68 the pivot arm 72 is pivoted outward, thereby spreading the arms. Inserted there between and positioned against the angled members 38 rest the target board as shown in phantom in FIG. 10. When the arms are released the spring tension clamps the board holding it into place. As seen in FIG. 9, the rotating member 60 rotates about the cross bar 20 to allow the board clamping device 68 to position at various heights. The position of the rotating member 60 is fixed by inserting the fastening pin 82 into the appropriate aligned holes. As illustrated by arrows in FIG. 11, the angle of the target board can also be altered by rotating the extension member 64 within the hub 62. This station trains participants in techniques required for front kicks, side kicks, elbow strikes, hammer fist, knife hand, and palm heel.

From the preceding, it should be evident that the invention has satisfied a need in providing modular units having collectively mounted thereto adjustable training stations. The structure affords versatility to one or more participants for simultaneous training with various training stations. Broadly, the invention obviates the need for manual board holders while combining and improving what has heretofore been a series of independent training devices for presentation at a single location in a mutually cooperative relationship.

As should be apparent from the foregoing specification, the invention is susceptible to being modified with various alterations and modifications which may differ from those which have been described in the preceding specification and description. Accordingly, the following claims are intended to cover all alterations and modifications which do not depart from the spirit of the invention.

What is claimed:

1. A universal martial arts training apparatus comprising:

a support module, said support module including first, second and third vertically oriented pole members, said pole members being equidistantly spaced from any one of the other of said pole members, at least two L-shaped interconnecting members, at least one of said interconnecting members connecting each of the first, second and third pole members together at each of their respective ends thereby providing a rigid frame structure, a speed break, said speed break comprising an arched extension member having an end slidably attached and mounted to said upstanding support module by dual collar members and a second end, said second end of said extension member including an apertured angle member, a flat member having threaded bolt members extending therefrom which are received by said aperture in said angled member and fastened in position by spring members and fastening nuts, and upper and lower mounting means which secure said module to a structural support member.

2. A universal martial arts training apparatus comprising:

a support module, said support module including first, second and third vertically oriented pole members said pole members being equidistantly spaced from any one of the other of said pole members, at least two L-shaped interconnecting members, at least one of said interconnecting members connecting each of the first, second and third respective ends thereby providing a rigid frame structure, a power break, said power break comprising a cross bar which is slidably mounted to said support module and shelving members, having vertically spaced walls attached to said cross bar by horizontal supports, said shelving members further including angled members equally spaced along said vertically spaced wall adapted to receive board members; and upper and lower mounting means which secure said module to a structural support member.

3. A universal martial arts training apparatus comprising:

a support module, said support module including first, second and third vertically oriented pole members said pole members being equidistantly spaced from any one of the other of said pole members at least two L-shaped interconnecting members, at least one of said interconnecting members connecting each of the first, second and third pole members together at each of their respective ends thereby providing a rigid frame structure, a board holder, said board holder comprising a cross bar which is slidably mounted to said support module and having slidably fitted thereon a rotating member having a central hub which extends perpendicularly therefrom to receive an extension member which has attached at and end a board clamping device, said board clamping device including a header which is centrally attached to said extension member, a fixed arm attached adjacent and edge of said header and a pivoting arm attached to an opposite edge of said header, both of said arms being connected together by a spring member, wherein on the other ends of said arm members are attached angled members which are adapted to receive target board member and;

upper and lower mounting means which secure said module to a structural support member.

* * * * *